US007713133B2

(12) United States Patent
Wolf

(10) Patent No.: US 7,713,133 B2
(45) Date of Patent: May 11, 2010

(54) SURFACE COMPOSITION FOR CLAY-LIKE ATHLETIC FIELDS

(76) Inventor: Ann Marie Alia Wolf, P.O. Box 65782, Tucson, AZ (US) 85728

( * ) Notice: Subject to any disclaimer, the term of this patent is extended or adjusted under 35 U.S.C. 154(b) by 1493 days.

(21) Appl. No.: 10/236,354

(22) Filed: Sep. 6, 2002

(65) Prior Publication Data

US 2003/0114343 A1 Jun. 19, 2003

(51) Int. Cl.
*A63C 19/04* (2006.01)
*A63C 19/00* (2006.01)

(52) U.S. Cl. ..... 472/91; 472/94

(58) Field of Classification Search ..... 472/88–94, 472/85, 86; 404/17, 44; 428/85, 87, 92, 428/97, 91
See application file for complete search history.

(56) References Cited

U.S. PATENT DOCUMENTS

| | | | | | |
|---|---|---|---|---|---|
| 2,837,984 | A | * | 6/1958 | Klotz | 404/2 |
| 3,771,787 | A | * | 11/1973 | Wood, Jr. | 472/92 |
| 3,974,312 | A | | 8/1976 | Stevens et al. | |
| 3,995,079 | A | | 11/1976 | Haas, Jr. | |
| 4,044,179 | A | * | 8/1977 | Haas, Jr. | 428/17 |
| 4,307,879 | A | | 12/1981 | McMahon et al. | |
| 4,332,620 | A | | 6/1982 | Quinn | |
| 4,336,286 | A | | 6/1982 | Tomarin | |
| 4,396,653 | A | | 8/1983 | Tomarin | |
| 4,523,755 | A | * | 6/1985 | Turba | 472/92 |
| 4,606,963 | A | | 8/1986 | Farrell | |
| 4,881,846 | A | | 11/1989 | Burkstaller | |
| 4,897,302 | A | | 1/1990 | Bull | |
| 5,006,013 | A | | 4/1991 | Burkstaller et al. | |
| 5,190,811 | A | | 3/1993 | Rossi | |
| 5,352,158 | A | * | 10/1994 | Brodeur, Jr. | 472/92 |
| 5,411,352 | A | | 5/1995 | Eren | |
| 5,678,951 | A | | 10/1997 | Levasseur | |
| 5,961,389 | A | | 10/1999 | Dickinson | |
| 6,242,062 | B1 | | 6/2001 | de Vries | |
| 6,464,082 | B1 | * | 10/2002 | Kimmel et al. | 209/12.1 |
| 2003/0062432 | A1 | * | 4/2003 | Whettingsteel | 241/99 |

FOREIGN PATENT DOCUMENTS

| | | | |
|---|---|---|---|
| GB | 2 279 957 | * | 1/1985 |
| JP | 08253355 A | * | 10/1996 |
| JP | 09003814 A | * | 1/1997 |
| JP | 11001903 A | * | 1/1999 |

* cited by examiner

*Primary Examiner*—Kien T Nguyen
(74) *Attorney, Agent, or Firm*—Quarles & Brady LLP; Gavin J. Milczarek-Desai

(57) ABSTRACT

New clay-like athletic surface compositions that utilize different types of glass cullet, such as container, ceramic, or plate glass, are provided. Preferably, recycled container-glass cullet between 1.4 millimeters and 20 microns in size is used to provide a slow playing, resilient surface good for a variety of athletic purposes, such as tennis, track and field, and bocce.

13 Claims, 10 Drawing Sheets

SURFACE COMPOSITION FOR CLAY-LIKE ATHLETIC FIELDS

STATEMENT OF RELATED APPLICATION

This application claims the filing date benefit of U.S. patent application Ser. No. 09/871,091, filed on May 31, 2001, the contents of which are incorporated by reference herein.

BACKGROUND OF THE INVENTION

1. Field of Invention

The invention generally relates to indoor and outdoor play surfaces for games and activities, especially where a ball is used. More particularly, the invention relates to tennis court surfaces that include cullet obtained from waste glass.

2. Description of the Related Art

Early athletic surfaces, particularly tennis court surfaces, were constructed from concrete, grass, asphalt or clay. Each of these surfaces has significant deficiencies. Clay surfaces, which strictly speaking are only those surfaces utilizing natural clay (i.e., naturally occurring hydrated silicate materials), are soft and easy to play on. However, clay surfaces are expensive to install, difficult to maintain, and must be closed after the first frost in cold climates. Asphalt and concrete are unyielding surfaces that frequently cause injuries. In addition, concrete and asphalt surfaces, when exposed to extremes of heat and cold and to water and ice, often crack or split, thus making them less useful and subject to constant repair. Moreover, grass wears badly with frequent use and is difficult to maintain in good condition when the weather is very hot or cold.

Due to longer life spans and an increasing emphasis on keeping up physical activity later in life, attention has recently re-focused on providing play surfaces that tend to minimize stress to joints and injury in general. Thus, giving yet resilient clay-like surfaces have been developed for use on tennis courts, as well as for track and field and other athletic play applications, in the hopes of providing a cost-effective surface composition that reduces injuries. However, since economy is still a primary concern, alternatives to the traditional clay play surfaces must ideally still be low cost, inexpensive to maintain, and able to be used in varying weather conditions.

One improved clay-like product is sold under the trademark Classic Clay. Classic Clay is reddish maroon or green in color and is a manufactured, polymer-coated silica. It is filled into a carpet of specified height and is piled over the top of the carpet by about 2 mm. Classic Clay has a static charge, which causes the particles to cling to tennis balls, clothing and shoes. In terms of play characteristics, surface speed is moderate and Classic Clay is hydrophobic, meaning it does not mix well with water, and, thus, provides good playability when moist. However, Classic Clay stains tennis shoes and accessories a reddish color.

Naturally existing sand is another alternative. Natural sand is tan or grayish in color (similar to beach or playground sand) or, when crushed brick is added, pinkish in color. Sand used in tennis courts typically exists as a 6.5-9 cm compacted layer on top of 7.6 cm of compacted aggregate, with fines further compacted on rolled local soil. The play is quite slow with a great amount of sliding. Moreover, while sand courts require regular irrigation to saturate the surface, they cannot be played on when truly wet, such as after a moderate rain.

Another clay-like product is called Har-Tru. Har-Tru is a trademark for a bluish green to light blue in color product made from mined and modified shale and slate. Har-Tru American Red is crushed red stone and crushed red brick. Neither contain a binder to aid in draining. Generally, Har-Tru courts are kept moist to improve surface performance, which can result in a high maintenance bill. While the overall construction is similar to courts made with natural sand, many desirable options, such as built-in irrigation and lining, can make construction quite costly. Play is rather slow, with minimal sliding. However, Har-Tru courts can be slippery after a rain.

Other "alternative" athletic play surfaces for clay-like running tracks, tennis courts, bocce fields and the like have also included resilient synthetic plastic materials or other types of resins laid over the ground or concrete. These plastic or resinous materials, such as the products sold under the trademark "Astroturf," have enjoyed significant commercial success. However, they also tend to be relatively expensive to install and provide a play surface that is thought to increase the risk for certain types of knee and foot injuries. Moreover, many of these surfaces are unsuitable for tennis and ball sports. This holds true even for improved plastic surfaces. For example, U.S. Pat. No. 4,307,879 by McMahon et al. describes an athletic surface made from a glass-fiber reinforced resinous material. While this material may exhibit improved characteristics for running applications, its bounce and spin characteristics appear to be incompatible with ball sports such as tennis. Hence, those in need of an athletic surface for running and ball sports have returned to examining variations on more traditional athletic surface compositions.

Accordingly, clay courts and clay-like surfaces are again coming into favor, particularly by older athletes. This is because clay and clay-like compositions are characterized by a soft, spin receptive surface that induces slow play in ball sports and helps to reduce player injuries. For example, in the context of tennis, soft courts are 10% of the $400 million U.S. court market. These courts are designed as either compacted clay-like surfacing material or surfacing material placed in a carpet, with the latter usually referred to as synthetic clay or in-fill courts. The market for these non-hard courts is increasing each year and projections indicate that the aging "baby boomers" will create continued increases in demand. In fact, all the newer clubs in traditional retirement localities, such as the Palm Springs area of Calif., have soft courts. In Arizona, several clubs in the Tucson and Phoenix metropolitan areas are replacing their hard courts with soft clay or clay-like courts.

New surfacing material must be added each year to "soft" playing fields (e.g. tracks, bocce fields) and tennis courts—leading to a substantial annual market. Because most courts and tracks are still of the so-called "hard surface" (e.g., concrete and asphalt) type, market growth is not projected to plateau for decades. Taking recent projections relating to clay or clay-like tennis courts in Australia as an indication of growth, soft court surface popularity will overtake other surface use in the coming years, with approximately 75% of the new courts using silica in-fill. In turn, each in-fill court uses approximately 10 tons of clay or clay-like material initially and 300 pounds for maintenance per year.

Due to the large amount of granular material used in various clay or clay-like compacted or in-fill athletic surfaces, manufacturers and those who maintain such surfaces are constantly looking for inexpensive alternatives. Thus, there continues to be a need for an inexpensive, widely available, and inert material for use in the manufacture and maintenance of clay and clay-like athletic surfaces.

SUMMARY OF THE INVENTION

The invention meets the aforementioned need by providing glass cullet as an inexpensive, widely available source of granular material for clay-like athletic surfaces. The invention stems from the discovery that broken waste glass (cullet) having a size of about 1.4 millimeters or less in diameter provides play characteristics similar to other types of popular granular materials on clay-like surfaces. Preferably, the cullet particles range in size from a diameter of about 1.4 millimeter (14 mesh) to about 20 microns (625 mesh). The preferred size range of cullet particles has been found to provide an especially desirable level of performance for tennis court applications. However, cullet particle sizes above and below the preferred range have been found to be effective as a granular material for using in a wide variety of clay-like athletic surface applications.

DEFINITIONS

The term "cullet" includes any type of broken refuse glass, such as, but not limited to, container glass (e.g., recyclable glass jars or bottles) of all colors, uncolored glass, plate glass (e.g., window panes), ceramic glass (e.g., coffee mugs), and mixtures thereof. For consistency throughout the specification, the use of the term "cullet" shall refer to broken recyclable-container glass (uncolored, colored, or mixed) unless indicated otherwise. However, this definition is not meant to limit the invention to cullet of a particular glass composition.

As used in this description, the terms "mesh," "mesh size," "mesh value" or "mesh sieve size" generally are defined as the number of openings per inch of a sieve or screen. Since increasing the number of openings per inch in a sieve requires that the openings become smaller, an inversely proportional relationship exists between mesh value and the size of the particles passing through a given screen. In practice, mesh values can indicate either a wide range of cullet particle sizes (i.e. a given size or less) that pass through a particular sieve or a precise range of particle sizes. For example, if a cullet sample is screened only with a 200 mesh sieve, the particles that pass through would be 75 microns in diameter or less (down to sub-micron sizes). If, however, the 200 mesh cullet sample subsequently is screened with a 230 mesh sieve, all 200 mesh particles that do not pass through the 230 mesh sieve will be approximately 63 microns diameter. In this manner, a given mesh number may indicate particles of one or a few precise sizes or may indicate a wide range of sizes below a certain maximum size. Unless otherwise indicated, all mesh values cited in this disclosure represent cullet particles that have been precisely sized.

The term "soft courts" or "soft surface" means clay and clay-like athletic surfaces and tennis courts.

The term "clay-like" athletic surface means an athletic surface that utilizes a granular surfacing material as a clay substitute in either a compacted form or as an in-fill material in a carpet-like substrate. Clay substitutes simulate the look and feel of traditional clay tennis courts and include, but are not limited to, sand, naturally occurring stone crushed and sometimes blended with a chemical binder to form a homogeneous mixture which allows water to filter through the surface, polymer coated substances, and controlled blends of crushed stone and crushed brick. In-fill materials placed in a carpet-like substrate are often referred to in the art as "synthetic clay."

The term "granular material" or "surfacing material" means any particulate matter used in the composition of a clay-like athletic surface. Of course, either one or a combination of granular material may be used in a given surface.

The term "tennis court substrate" means any ground preparation used in the construction of a clay or clay-like tennis court and to which a surfacing material is applied, including, but not limited to, dirt or sand, compacted dirt, compacted stone, cement foundations, carpets, and combinations thereof.

Approximately 6 to 12% of municipal solid waste (MSW) is glass. About 10.6 million tons of glass containers were manufactured in the U.S. in 1995: 63% flint (clear), 25% amber (brown), 10% green and 2% blue or other colors. Importation of glass containers for products like beer and wine account for additional tonnage. Containers account for over 90% of all glass in MSW. Glass is a widely recycled material in recycling programs with an estimated 98 percent of the America's 7,000 curbside recycling programs picking up bottles and jars. However, without strong markets for these materials, much glass ends up in landfills, even in places that have established recycling programs. And, despite assertions to the contrary, glass-packaged products and the resulting waste are not going away: In the beer packaging market, the glass share rose from 25% to 37% in the last decade.

The ability to effectively recycle glass is hindered by the low market value, high processing costs, and high transportation costs to the few glass remanufacturing facilities. Commingled collection of recyclables is most popular with residents and program managers but presents problems for the commercial use of recycled glass. Most glass users require sorting of glass by type and color and want unbroken glass. Communities often lose money on their glass recycling programs or have been forced to eliminate glass from their programs entirely. In fact, glass plants pay so little that shipping collected glass is often not economically feasible. Moreover, the value of glass is flat everywhere with little expectation of an increase.

Cullet needs a new and stable market if meaningful diversion from landfills is to continue. A new stable market for glass containers, whole or broken, will provide an outlet for collected material that otherwise costs significant amounts of money to collect, sort, and ship. A market such as this will increase the value of cullet so that collection will become attractive. Ground cullet has the potential to create new businesses and new jobs rather than be a burden for the community in addition to helping existing recycling businesses.

An object of this invention is to provide a clay-like athletic surface composition made with cullet that has performance characteristics that are comparable or better than existing natural clay or clay-like materials.

A second object of this invention is to provide a clay-like athletic surface composition that is made from a renewable resource instead of from virgin raw materials that must be mined.

A third object of this invention is to provide a granular material for use on clay-like athletic surfaces that avoids the use or discharge of substances that can be harmful to human health or to the environment.

A fourth object of the invention is to provide a granular material for use on clay-like athletic surfaces that is inexpensively produced using commonly-available materials.

A fifth object is to provide a granular material for use on clay-like athletic surfaces that promotes the use of post-consumer glass.

A sixth object of this invention is to provide a granular material for use on clay-like tennis courts that possesses properties that are comparable or better then other granular materials already in use.

The invention accomplishes these and other objects by providing a novel and improved granular material made from cullet for use on clay-like athletic surfaces.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments, and particularly pointed out in the claims. However, such drawings and description disclose only some of the various ways in which the invention may be practiced.

DETAILED DESCRIPTION OF THE INVENTION

Figure 1:
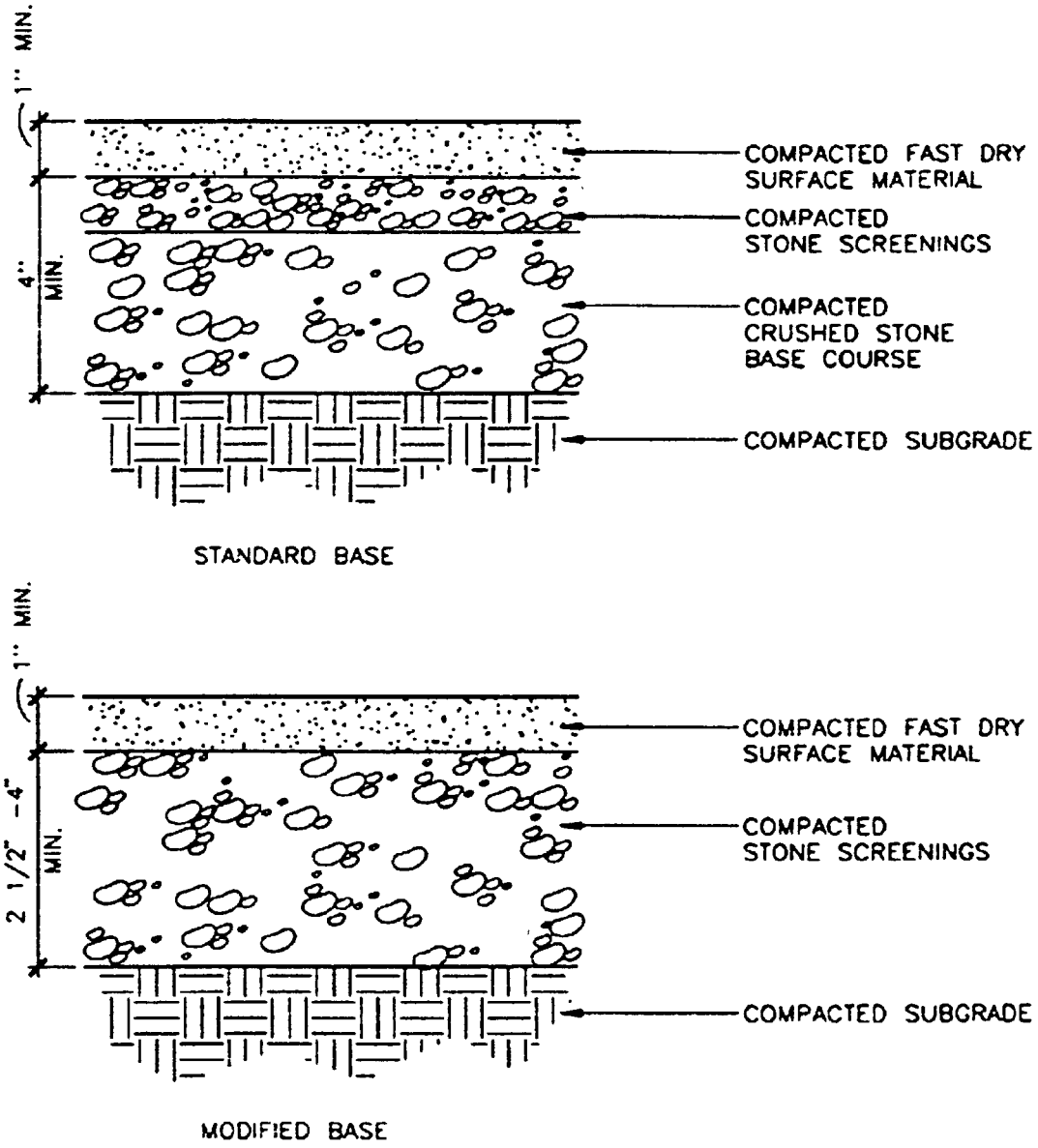
FIG. 1 schematically depicts in cross-section the structure of two typical compacted, clay-like tennis courts (from "Tennis Courts, A Construction and Maintenance Manual", The United States Tennis Court and Track Builders Association and the United States Tennis Association, 1998).

The invention, in general, provides a novel athletic playing surfacing material composed of cullet. More specifically, the invention relates to novel and improved clay-like athletic surfaces that utilize ground cullet as a compacted or in-fill granular material. A preferred sized range of cullet for tennis court applications is 20 microns-1.4 millimeters in diameter, with cullet 250-600 microns in diameter being most preferred.

With the resurgence of interest in clay court and field surfaces in the United States and around the world, natural and clay-like materials are in demand. However, because traditional clay surfaces require frequent replenishment and care, clay substitutes are gaining in popularity. At present the substitutes for natural clay are primarily crushed rock, sand, crushed brick, and polymer-coated silica. Therefore, court manufacturers are looking for new clay substitutes that work better, are locally available, and/or are less costly than existing alternatives.

Based upon the research described herein, cullet has the potential to replace traditionally used granular materials on clay-like athletic surfaces. For example, cullet may be used in place of natural clay or clay substitutes in the construction of a tennis court.

The Use of Cullet as a Tennis Court Surface

Research performed by the inventor indicates that cullet has great potential to provide a superior and less expensive alternative to existing clay and clay-like granular material. Cullet overcomes many of the problems with current clay-like surfacing materials: it does not require watering, the color coating does not come off and stain players or their equipment, the particles are not so rounded as to cause slippage while playing, cullet contains no free silica causing silicosis from exposure to crystalline silica particles, and it is widely and cheaply available. Moreover, using cullet also has potential to reduce chemical and other hazardous waste because the materials presently in use on clay-like courts require mining and chemical processing. Since cullet can be used without processing other than sizing, both environmental and safety concerns can be reduced.

Processing of Cullet

Cullet was received as crushed pieces approximately 5 to 10 cm in size from commercial sources (Container Recycling Alliance, TriVitro Corporation, and Spectrum Glass). Specific colors were collected in-house. Before use, the cullet was ground utilizing a ball mill. As would be known to one skilled in the art, a ball mill consists of cylindrical shells or chambers rotating on a horizontal axis mounted on a frame. The mill reduces the size of cullet by tumbling the cullet in a chamber with ceramic balls. The grinding medium and the cullet to be processed are loaded and discharged through openings in the chambers. During the tumbling process, balls follow complex trajectories impacting each other and the walls of the tumbling chamber. Glass particles are fractured during these collisions as they are caught between colliding surfaces. Optimal results are achieved with the chamber slightly over half full. The highest efficiency is achieved when the chamber is rotated at the highest angular momentum possible without trapping balls against the walls with centrifugal forces. At proper speed, balls follow the rotation of the chamber (and other balls), up to a critical point where they fall under the action of gravity. The impact zone at the bottom of this fall is where most size reduction takes place.

One concern with this type of mill is the erosion of the ball media and chamber liner, resulting in contamination of the cullet. However, the rate of media/liner loss is engineered to be extremely low on the time-scale required for milling an individual batch. This is accomplished through the use of extremely hard, ceramic media and liners. Typically, aluminum oxide ceramics are used for both the grinding media and mill liner. The cullet and ceramic balls are place in the jars and spun on the ball mill for a specific period of time depending on the size desired. The contents of the jars are then dumped onto the screens. The first screen retains mainly the ceramic balls. The second screen retains cullet that needs additional grinding. The remaining cullet then is further sized before being used.

Cullet was fine sized utilizing a Keck Sieve Analysis Field Kit (U.S. Bureau Standards) and ATM Testing Sieves (ASTM E-11, ISO and ANSI specifications). Fine sizing requires simply shaking of the materials through sieves of the appropriate mesh size. Thus, the grinding equipment grinds the cullet to wide range of sizes and rounds the edges. Then, the sieves separate the cullet into different sizes.

Evaluating the Characteristics of Cullet Versus Other Clay-Like Surfacing Materials A. Health Issues Literature was reviewed to find any deleterious health effects from cullet. The primary concern is skin and eye contact, although inhalation is also a concern. Silica naturally occurs as a mineral in crystalline form. Glass is a silicate melted and cooled; once cooled it is amorphous, i.e., non-crystalline in structure. Silicosis results from crystalline silica causing damage to the lungs. Ground glass is recognized by the Occupational Safety and Health Administration (OSHA) as a "nuisance dust," according to regulations governing the permissible levels of dust but is considered innocuous and specifically recognized as not causing silicosis. In fact, OSHA does not list any health effects at all for amorphous silica, including no irritation to skin or eyes. On the other hand, Classic Clay is a polymer coated silica and most other surfacing materials also contain free crystalline silica. While the heath effects of these products are unknown, the nuisance dust generated from play may pose a risk of silicosis or other health effects.

B. Color—Acceptability and Availability

The primary colors utilized today are variations in red and green, although a wide variety of other colors exist. The main concerns are how the cullet functions as a surface, contrast between the cullet surface and tennis balls (usually bright yellow), and the contrast between the lines (usually white or black) and the cullet surface. Current tennis court colors do not have to be matched exactly. In fact, manufacturers are looking for new colors for tennis courts. Nonetheless, colors must be "pleasing" colors, especially with the greens. Accordingly, colors of cullet can be standardized utilizing the in-house optical instrument.

The inventor has produced a mint, an amber, a blue/green similar in color to Har-Tru Regular Blend, a tan similar to natural sand, a red/tan similar in color to the natural sand with crushed brick, a red similar to Classic Clay red, and a sandy color similar to the Nova Sand. All have good contrast with the bright yellow tennis balls and are thought to be acceptable if not "pleasing" for tennis courts. The colors were obtained from utilizing amber, flint, green, blue, mixed and red cullet. Red was obtained from Spectrum Glass, a manufacturer of art glass and is post-industrial glass waste. All other cullet were formerly container glass. Of significance to the waste glass market is the finding is that mixed cullet (cullet of mixed color) has good contrast with tennis balls; it is the least desirable cullet from a recycling standpoint and the lowest priced.

Although a "Classic Clay red" cullet color was obtained, the inventor continues to investigate other options because of the cost of the red cullet. Possible options include modifications during court construction and/or modifications of the cullet. For example, during court construction red cullet could be used on top and mixed cullet on the bottom and/or the cullet could be mixed with the polymer-coated silica to provide a suitably colored material at a lower cost. Furthermore, the cullet can be polymer coated if desired (though this is not necessary), and other color modification techniques may be established.

C. Particle Shape

Cullet, Classic Clay red, Classic Clay green, natural sand, natural sand with brick, Nova Sand and Har-Tru Regular Blend (Har-Tru) and Har-Tru American Red (American Red) were examined under a microscope for similarities and differences in structure and integrity. The Har-Tru and American Red were difficult to view with a microscope and had a large variety in particle size and shape. The most notable deduction drawn was the fact that the polymer coating on the Classic Clay is quite prone to removal by abrasion leaving basically a mass of silica. In fact, informally tested Classic Clay on a tennis court for approximately six months had much less polymer coating than unused material. This has at least two effects on the courts; the color fades as the polymer coating is removed and the courts contain uncoated crystalline silica.

Visual comparisons yielded one major conclusion: While Classic Clay, natural sand, natural sand with brick, Nova Sand, and cullet are quite similar in overall gross structure, the cullet and natural sand were not as round as Classic Clay and Nova Sand. The Classic Clay particles are largely round (in fact, rounder than all the other materials) and granular with some subangular blocky and columnar matter. The majority of particles of the natural sand (with or without brick) are subangular blocky, with some columnar and prismatic shapes. Similarly, the cullet particles are primarily angular blocky with some subangular blocky and prismatic matter. The Nova Sand contains columnar particles with rounded, not sharp edges.

D. Particle Size Distribution

The particle size distribution tells the size of particles in the material as well as the percentage of each size. This allows grinding of cullet samples to a comparable size as the other surfacing materials and allows for tests of different distributions to see if one functions better than another. A set amount of the different surfacing materials is shaken through sieves of different mesh sizes. If material passes through a 40 mesh sieve but is retained by a 60 mesh, it is considered 40 mesh. Amounts for each mesh are weighed and the percentage calculated.

The particle size distributions are given in the following table:

TABLE 1

Particle Size Distributions for Commercial Surfacing Materials

| | Surfacing Material (%) | | | | | |
|---|---|---|---|---|---|---|
| Mesh | Har-Tru | Classic Clay | Nova Sand | Natural sand | Natural sand w/brick | Am. Red |
| >20 | 16.88 | 0.40 | 0.00 | 3.52 | 14.49 | 11.42 |
| 20 | 16.52 | 0.33 | 0.00 | 16.59 | 17.39 | 26.04 |
| 30 | 21.81 | 0.75 | 2.32 | 56.22 | 14.09 | 2.10 |
| 35 | 22.52 | 67.60 | 35.30 | 42.38 | 18.24 | 15.97 |
| 40 | 12.94 | 27.03 | 42.08 | 29.84 | 20.66 | 16.79 |
| 60 | 0.36 | 3.71 | 14.78 | 4.74 | 2.64 | 2.76 |
| 80 | 5.48 | 0.55 | 2.23 | 1.58 | 5.08 | 3.17 |
| 100 | 3.34 | 0.00 | 2.61 | 0.95 | 4.18 | 7.80 |
| 120 | 0.06 | 0.00 | 0.38 | 0.12 | 1.37 | 5.37 |
| 140-180 | 0.04 | 0.00 | 0.29 | 0.17 | 1.61 | 7.39 |
| 200 | 0.01 | 0.00 | 0.00 | 0.01 | 0.18 | 0.63 |
| >200 | 0.01 | 0.00 | 0.00 | 0.07 | 0.06 | 0.57 |

Classic Clay and Nova Sand are much more uniform than the other surfacing materials, primarily two mesh sizes (35 and 40 mesh). These are manufactured materials versus Har-Tru, natural sand, natural sand with brick and American Red, which are basically mined materials and come in a wide variety of mesh sizes. The size distribution of a surfacing material affects the play characteristics of the court. Smaller sizes tend to compact more and produce faster play. Sometimes larger sizes are placed on top to help with sliding. Advantageously, cullet can be economically sized and mixed as per a court manufacturer's specification to meet different styles of play.

Similarly sized cullet samples were produced for comparison to each clay-like surfacing material tested. The term "similarly sized" is defined as having the same proportion of mesh sizes of cullet, and, if possible, the same color. These "matched samples" were used in experiments to compare the cullet to the other surfacing materials.

E. Volume Occupied and Specific Gravity

The specific gravity and volume occupied were calculated for each surfacing material. If the material is too heavy it may not move well; but if too light, it may move too well and be easily transported by wind and rain. The calculated values are given in Table 2 below. The cullet samples are the least dense, or occupy more volume per ton of material. This can be an advantage as the price per surfacing material is usually priced per ton. Thus, a builder needs fewer tons of cullet than the other surfacing materials to fill a court.

TABLE 2

Volume Occupied and Specific Gravity of Tennis Court Materials

| Material | Volume Occupied (g/cc) | Specific Gravity |
|---|---|---|
| Mixed cullet natural sand match | 1.27 | 2.24 |
| Given value for TriVitro mixed cullet | 1.28 | 2.50 |
| Mixed cullet Classic Clay red match | 1.30 | 2.29 |
| Red cullet | 1.33 | 2.45 |
| Green cullet Classic Clay green match | 1.42 | 2.25 |
| Green cullet Har-Tru match | 1.43 | 2.25 |
| Green/blue cullet Har-Tru match | 1.45 | 2.21 |
| Amber cullet natural sand match | 1.46 | 2.16 |
| Amber cullet Classic Clay match | 1.47 | 2.10 |
| American Red | 1.52 | 2.21 |
| Classic Clay Green | 1.58 | 2.56 |
| Classic Clay Red | 1.59 | 2.79 |
| Natural sand | 1.59 | 2.40 |
| Nova Sand | 1.63 | 2.56 |

TABLE 2-continued

Volume Occupied and Specific Gravity of Tennis Court Materials

| Material | Volume Occupied (g/cc) | Specific Gravity |
|---|---|---|
| Natural sand with crushed brick | 1.70 | 2.49 |
| Har-Tu | 1.89 | 2.19 |

F. Contamination

While clean cullet is preferred, cullet produced from crushed post-consumer containers was used to build pilot courts. To date, no adverse effects of any kind have been seen.

G. Testing the Properties of Surfacing Materials

Reflectivity

Figure 2:
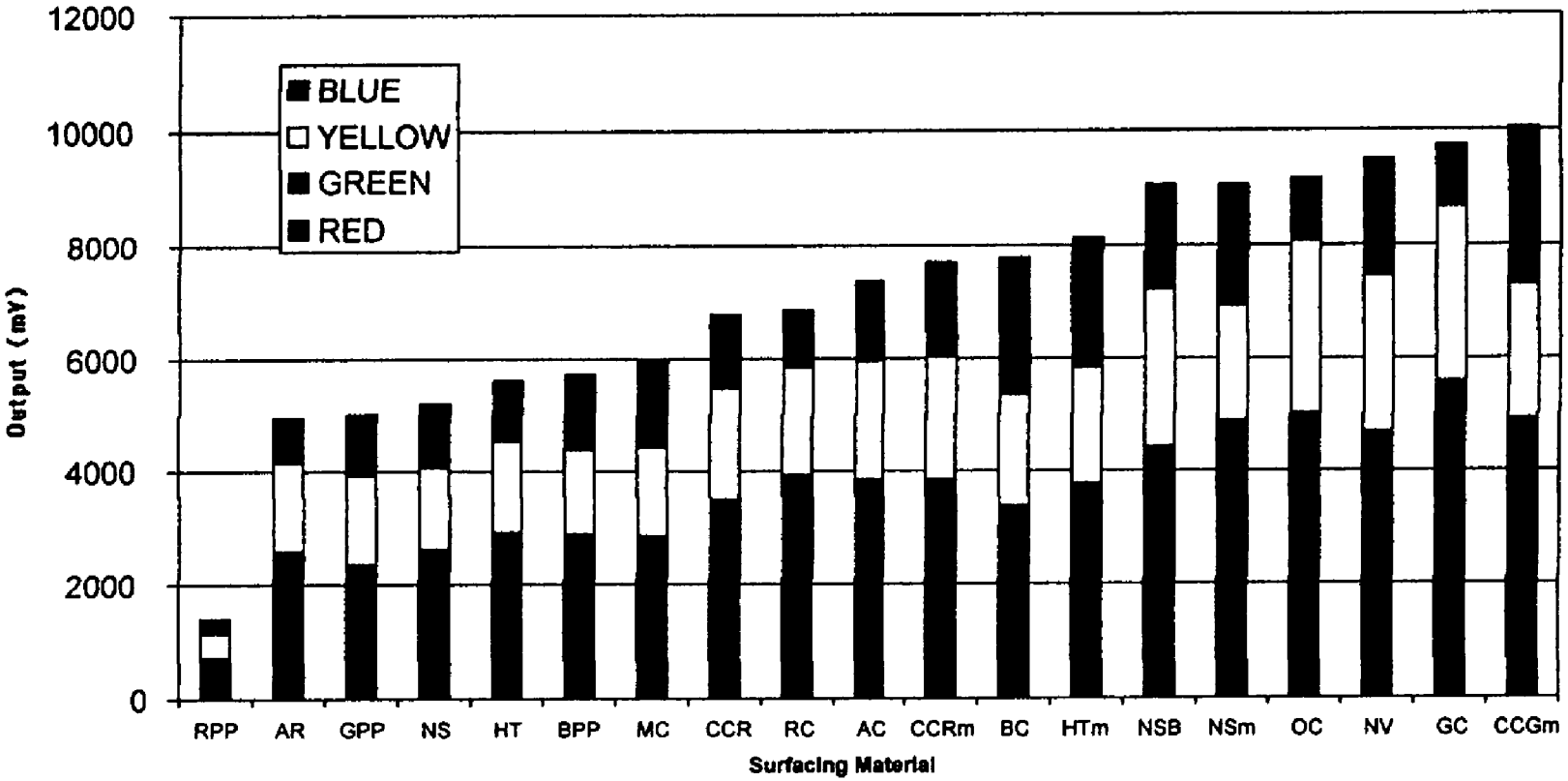
FIG. 2 shows the results of a test designed to evaluate whether cullet reflects more sunlight than other clay-like and hard court surfacing materials The abbreviations used are: Red Plexipave (RPP), American Red (AR), Green Plexipave (GPP), natural sand (NS), Har-Tru (HT), Blue Plexipave (BPP), Mixed cullet (MC), Classic Clay red (CCR), Red cullet (RC), Amber Cullet (AC), Mixed cullet Classic Clay red match (CCRm), Blue cullet (BC), Blue/green cullet Har-Tru match (HTm), natural sand with brick (NSB), Mixed cullet natural sand match (NSm), Orange cullet (OC) Nova Sand (NS), Green cullet (GC), and Green cullet Classic Clay green match (CCGm). Plexipaves are the acrylic surface on hard courts.

To evaluate if cullet reflects more in the sun than other clay-like materials, the reflectivities of the surfacing materials were calculated using an in-house optical instrument (data shown in FIG. 2). Diffused light from four light emitting diodes (blue, yellow, green, and red) was directed toward the sample to be evaluated. The instrument measured the light reflected from the sample to a detector (with results displayed in millivolts). Thus, the higher the millivolt value, the more reflective the material. Each sample was measured ten times with the average value used in subsequent calculations. The percent standard deviation of measurements was approximately 1.5%. As can be seen from the bar graph in FIG. 2, the reflectivities of the cullet samples are comparable to currently used surfacing materials. Nonetheless, fines may optionally be added to dull the material if desired.

Water Retention

To measure water retention, water was mixed with surfacing materials and allowed to air dry. The surfacing material samples were weighed every fifteen minutes, with the change in weight calculated representing the amount of water lost. Results are graphed in FIG. 3.

Advertised advantages of Classic Clay are that it does not have to be watered like many of the other materials and that it can receive a lot of rain and still be playable because it dries quickly. The Classic Clay red was hydrophobic and did not mix well. The water stayed on top, and the sample had to be stirred and shaken to mix for the test. The Har-Tru separated when the water was added, with water mixing with the finer particles while the larger sat at the bottom. Natural sand and the cullet samples mixed consistently and almost instantly with water.

Figure 3:
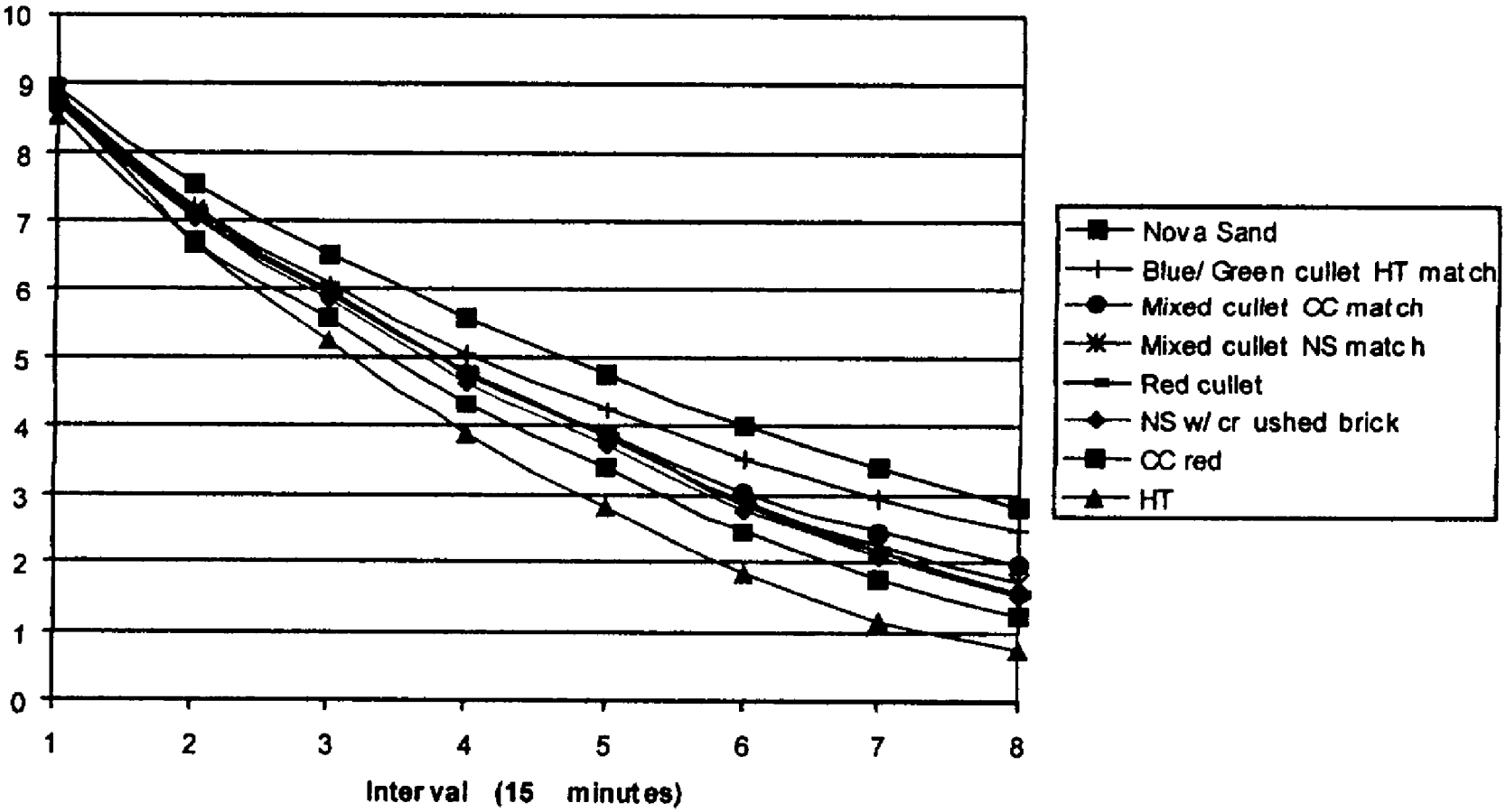
FIG. 3 shows the results of a test designed to measure water retention among the different clay-like surfacing materials. "CC" indicates Classic Clay, "HT" indicates Har-Tru, and NS indicates natural sand.

The Classic Clay red and the Har-Tru dried the most rapidly, while the Nova Sand and the blue/green cullet Har-Tru match dried the most slowly. The other samples behaved as a group and dried more slowly than the Classic Clay red and Har-Tru, especially in the first fifteen minutes. As is seen in FIG. 3, three of the four cullet samples performed indistinguishably from most of the other surfacing materials, with all of the surfacing materials performing roughly comparably.

Heat Conditions

Two tests were completed to measure the heat conduction of the surfacing materials. The thermal conductivities of the surfacing materials were calculated by applying a constant heat source for a set period of time to the surface of a set mass of material. Temperatures were recorded on the surface, 2.5 cm below the surface, and 5 cm below the surface. The thermal conductivity (k) of plate glass was known and was used as the standard. Heat flux by conduction is proportional to the temperature gradient. The change in temperature for the plate glass was recorded, and Q, the energy transferred, was calculated. Q is a function of the heat source and is constant. The other thermal conductivities were then calculated once ΔT was determined. Thus, the relationship between k, Q and ΔT is:

$$H=Q/\Delta t=kA(\Delta T/\Delta x)$$

where;

H=heat flux or heat capacity rate in which energy is transferred—joules/second

Q=the energy transferred in joules

Δt=change in time in seconds k=the thermal conductivity of material in watts times temperature in Kelvin/meters ΔT=change in temperature in Kelvin Δx=change in distance in meters A=surface area in meters.

Once Q is determined the equation can be rearranged to give:

$$k=(Q\Delta x)/(A\Delta T\Delta t)$$

The thermal conductivity reflects how easily the material transfers heat and are given in Table 3.

TABLE 3

Thermal Conductivities for Surfacing Materials

| Surfacing Material | Thermal Conductivity (WK/m) | Surface Temperature (° C.) |
|---|---|---|
| American Red | 2.186 | 52.0 |
| Red cullet | 1.610 | 51.0 |
| Classic Clay red | 1.390 | 51.5 |
| Natural sand with crushed brick | 1.344 | 49.0 |
| Har-Tru | 0.976 | 51.0 |
| Nova Sand | 0.976 | 60.0 |
| Mixed cullet (natural sand match) | 0.860 | 56.0 |
| Mixed cullet (Classic Clay red match) | 0.854 | 56.0 |

A material with a larger value will usually heat up and cool down more quickly than one with a smaller value. Crystalline solids transfer heat more readily than amorphous solids. The transfer also depends upon the void fraction, the pore size and the fluid contained in the pores. Cullet is an amorphous solid and the Har-Tru blends are metamorphous, while the Classic Clays and the natural sand with crushed brick are crystalline. Thus, cullet should transfer heat less readily than the other materials and did so in this experiment, except for the red cullet. The chemical composition of the red cullet may be affecting some of its thermal properties. Nova Sand, which is thought to be a crystalline material, functioned as an amorphous material. The surface temperature given is not necessarily applicable to the court surface temperature, because this test measured heat conductance rather than radiant energy.

Figure 4:
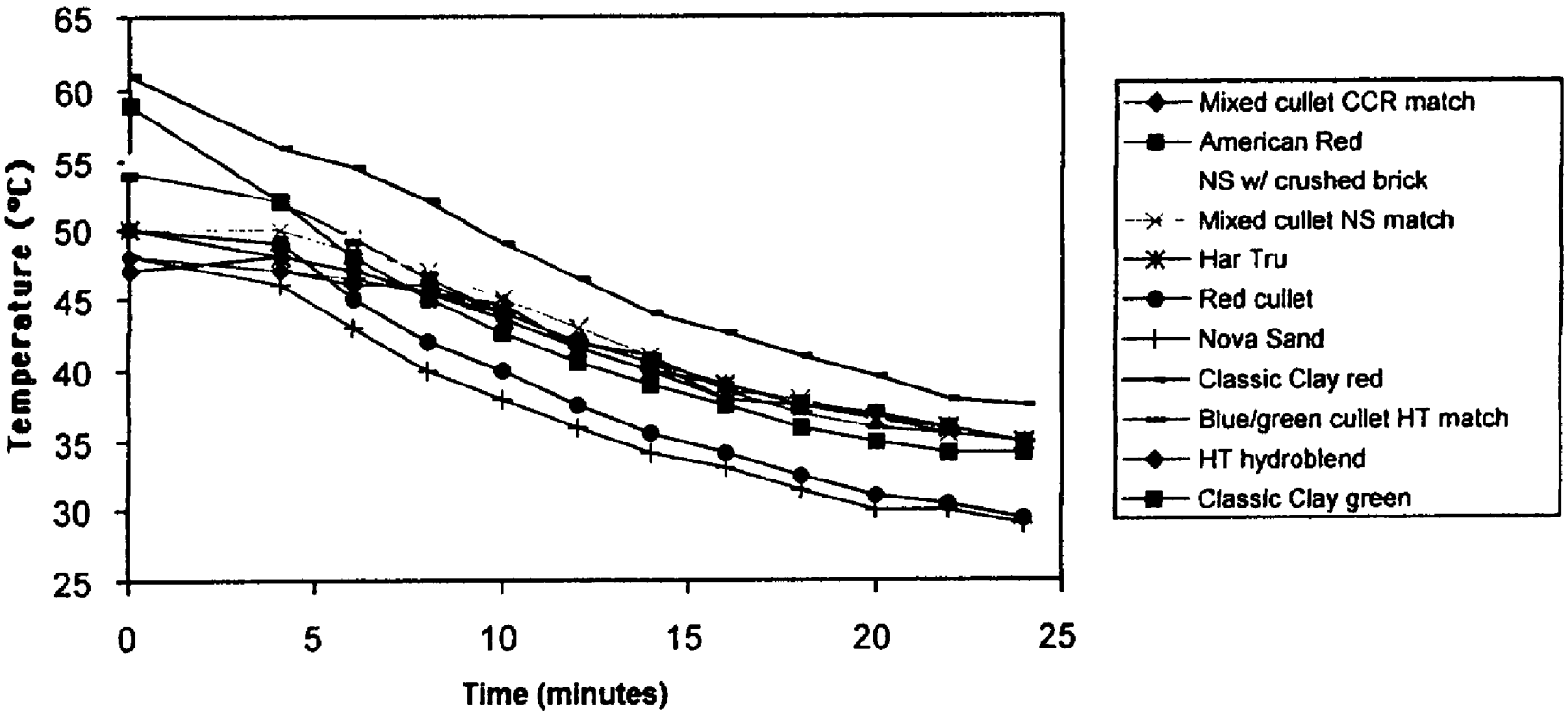
FIG. 4 shows the results of a test designed to measure heat retention among the different clay-like surfacing materials. "CCR" indicates Classic Clay Red; remaining abbreviations are as indicated above.

In the second test, samples were heated on a hot plate for a set period of time. The internal temperature of the material was recorded immediately after heating, four minutes after heating and every two minutes for twenty-four minutes. These results are given in FIG. 4. The data break into three groups. First, Classic Clay red, Classic Clay green and natural sand with crushed brick, which are all silica-based material. A linear regression analysis gave decreasing slopes of over one for these three materials, while all others ranged from 0.93 to 0.64. Thus, the Classic Clays and the natural sand with brick had the highest initial temperatures and cooled rapidly, but were still hotter than most others after twenty-four minutes. Classic Clay red was the hottest for all time periods, followed by the second group, Har-Tru blends and the cullet sized to match Har-Tru. Group two had lower initial temperatures than the Classic Clays and natural sand with crushed brick and cooled more slowly yet had a lower final temperature. The third group of data was red cullet and Nova Sand. Red cullet is thought to be plate glass, while Nova Sand is thought to be a crystalline silica material; however, in this test Nova Sand again performed similarly to the amorphous silica materials.

Both tests gave results that are consistent with the fact that crystalline solids transfer heat more readily than amorphous solids. Therefore, courts made with cullet will heat up more slowly than courts made with the other materials, and even though they are releasing heat more slowly, the low initial temperature will result in lower temperatures overall.

Surface Temperature

To measure the effect of radiant energy, the surface temperature of the materials was measured initially and after sixty minutes of sitting in the sun. As can be seen in Table 4, cullet does not produce a high surface temperature. As expected the temperature is more closely related to the color of the material. The darker colors such as Classic Clay and American Red had higher surface temperatures, while the lighter colors such as Nova Sand and mixed green cullet had lower surface temperatures.

TABLE 4

Surface Temperature for Surfacing Materials

| Surfacing Material | Change in Surface Temperature (° C.) |
|---|---|
| Classic Clay green | 25.0 |
| American Red | 22.0 |
| Amber cullet CC match | 21.5 |
| Red cullet | 21.0 |
| Classic Clay red | 17.0 |
| Brown Plexipave | 16.3 |
| Red Plexipave | 16.3 |
| Orange cullet | 15.5 |
| Green Plexipave | 15.3 |
| Har-Tru | 15.0 |
| Blue cullet | 14.3 |
| Nova Sand | 13.0 |
| Mixed cullet (natural sand match) | 12.3 |
| Green cullet | 11.3 |

Rain Transport

The effect of rainfall on the tennis court surfacing materials was determined and is shown in Tables 5 and 6. A set mass of surfacing material either compacted or used as in-fill was sprayed with a known volume of water. The surface area of the materials was consistent throughout the tests. The volume of water needed to initiate surfacing material movement was recorded as well as the mass of material moved for a given volume of water. One interesting result was that, despite the hydrophobicity attributed to the Classic Clay's polymer coating, it is much more easily transported by water than the other materials. The cullet surfaces performed almost identically, requiring the most water to move. Of course, this causes less shifting of the court surface and less of a need to keep adding more of the surface to the court. The Nova Sand performed similarly to the cullet except in the mass of the runoff, in which much more was transported indicating that surfacing material would need to be reapplied more frequently. The natural surfaces (i.e. Har-Tru and natural sand with crushed brick) had the least amount of runoff and in turn would require less resurfacing than all of the other surfaces tested.

TABLE 5

Rain Transport of Surfacing Material as Compacted Surface.

| Surfacing Material | Amount of Water to Initiate Movement (mL) | Mass of Run-Off (g) |
|---|---|---|
| Mixed cullet | 48.0 | 0.65 |
| Red cullet | 46.8 | 0.97 |
| Nova Sand | 40.8 | 1.48 |
| Har-Tru | 25.2 | 0.09 |
| Natural sand with brick | 20.4 | 0.20 |
| Classic Clay red | 4.8 | 0.59 |

Different values were obtained when the materials were used as in-fill in a plastic green turf, as shown in Table 6. In comparison with the compacted material by itself, the amount of water needed to create runoff from the turf was less. All four of the surfaces tested in the turf had the same mass of runoff. The amount of water needed to create that runoff, however, was different. The Classic Clay still needed the least amount of water to move, while the two cullet samples required the most water. The Nova Sand performed differently when placed in the turf, moving about as readily as the Classic Clay.

TABLE 6

Rain Transport of Surfacing Material as In-Fill.

| Surfacing Material | Amount of Water to Initiate Movement (mL) | Mass of Run-Off (g) |
|---|---|---|
| Red cullet | 27.6 | 0.13 |
| Mixed cullet | 22.8 | 0.09 |
| Nova Sand | 10.8 | 0.09 |
| Classic Clay red | 8.4 | 0.10 |

The conclusions drawn from the rain tests were that, for heavy rainfall areas, the cullet surfaces are advantageous because they would require the least amount of resurfacing. Preferably, the runoff effects demonstrated in these tests can be minimized by a court construction that includes a perimeter lip.

Wind Transport

Two tests were run to determine the effects of wind on different surfacing materials (Table 7). One test determined the total mass of surfacing material that may be moved. The other test determined the distance the surfacing material may be moved. Movement of the clay-like surfacing materials is limited by friction with the surface it is moving across, particle shape, size and weight. Nova Sand was displaced the most, followed by natural sand, mixed cullet, Classic Clay red, natural sand with crushed brick, and red cullet. The red cullet was very precisely sized as opposed to mixed cullet, which may account for the difference between the results of the two cullets. Very little Har-Tru moved as it readily compacts. Overall, cullet performed similarly to the other surfacing materials. Surfacing materials used as in-fill in carpets will lose less material than the same surfacing materials not in carpets. Preferably, court construction may include a perimeter lip, which reduces loss to wind.

TABLE 7

Wind Transport of Surfacing Material as a Compacted Surface.

| Surfacing Material | Mass lost (g) | Farthest Distance (cm) | Median Distance (cm) |
|---|---|---|---|
| Nova Sand | 18.49 | 132.5 | 66.7 |
| Natural sand | 16.12 | 130.0 | 73.5 |
| Mixed cullet | 14.79 | 143.0 | 58.5 |
| Classic Clay red | 10.36 | 139.0 | 56.0 |
| Har-Tru | 7.52 | 95.8 | 49.0 |
| Natural sand w/crushed brick | 5.29 | 140.5 | 65.0 |
| Red cullet | 4.88 | 113.3 | 58.0 |

Breakdown Over Time

The change in size over time of the different surfacing materials will effect the compaction, slide, maintenance, resurfacing frequency, and the overall cost of courts. To conduct breakdown testing, an in-house "scrubbing machine" was utilized to simulate wear while minimizing any inconsistencies in scrubbing patterns, strength and stroke number. The machine employs a variable speed motor with a base and two scrubbing arms. A typical test using the scrubbing machine proceeded as follows: The clay-like surfacing material was placed on the surface to be scrubbed. The scrubbing arm was fitted with a tray to hold 4 pounds of weight for applying pressure to the surface, with the motor set to constant speed. The scrubbing arm used a back-and-forth motion to scrub the surface. Thus, a stroke was defined as the movement of the arm in one direction; therefore, one time back-and-forth was counted as two strokes. A felt pad was chosen over traditional scrubbing pads to minimize any abrasiveness resulting from the pad. The pad was changed after each test.

The breakdown of the clay-like material was tested by scrubbing each material and conducting particle size distributions at the beginning and after 10,000 strokes. The total percent change for the materials is compared in Table 8. The red cullet changed the most over time, which may be a result of the different chemistry of plate glass. However, this is not expected to be a problem because the red cullet will likely be used in conjunction with another cullet, and the color is not changed much by the breakdown. The Har-Tru broke down the second most over time, which makes sense given that this material is a metabasalt. The natural sand and Classic Clay red followed. The natural sand is made up of a range of materials, some of which degrade more quickly then others. The Classic Clay result is thought to be due to the polymer coating breaking off, thereby exposing free silica. The Nova Sand tested between the natural sand and natural sand with crushed brick. Finally, the green cullet changed the least over time, which is advantageous because it would reduce maintenance requirements.

TABLE 8

Breakdown Over Time of Surfacing Materials.

| Surfacing Material | Percent Change in Particle Sizes |
|---|---|
| Green cullet | 3.0 |
| Natural sand with brick | 4.3 |
| Nova Sand | 6.7 |
| Natural sand | 7.4 |
| Classic Clay red | 8.0 |
| Har-Tru | 8.9 |
| Red cullet | 11.6 |

Abrasiveness a. General

Figure 5:
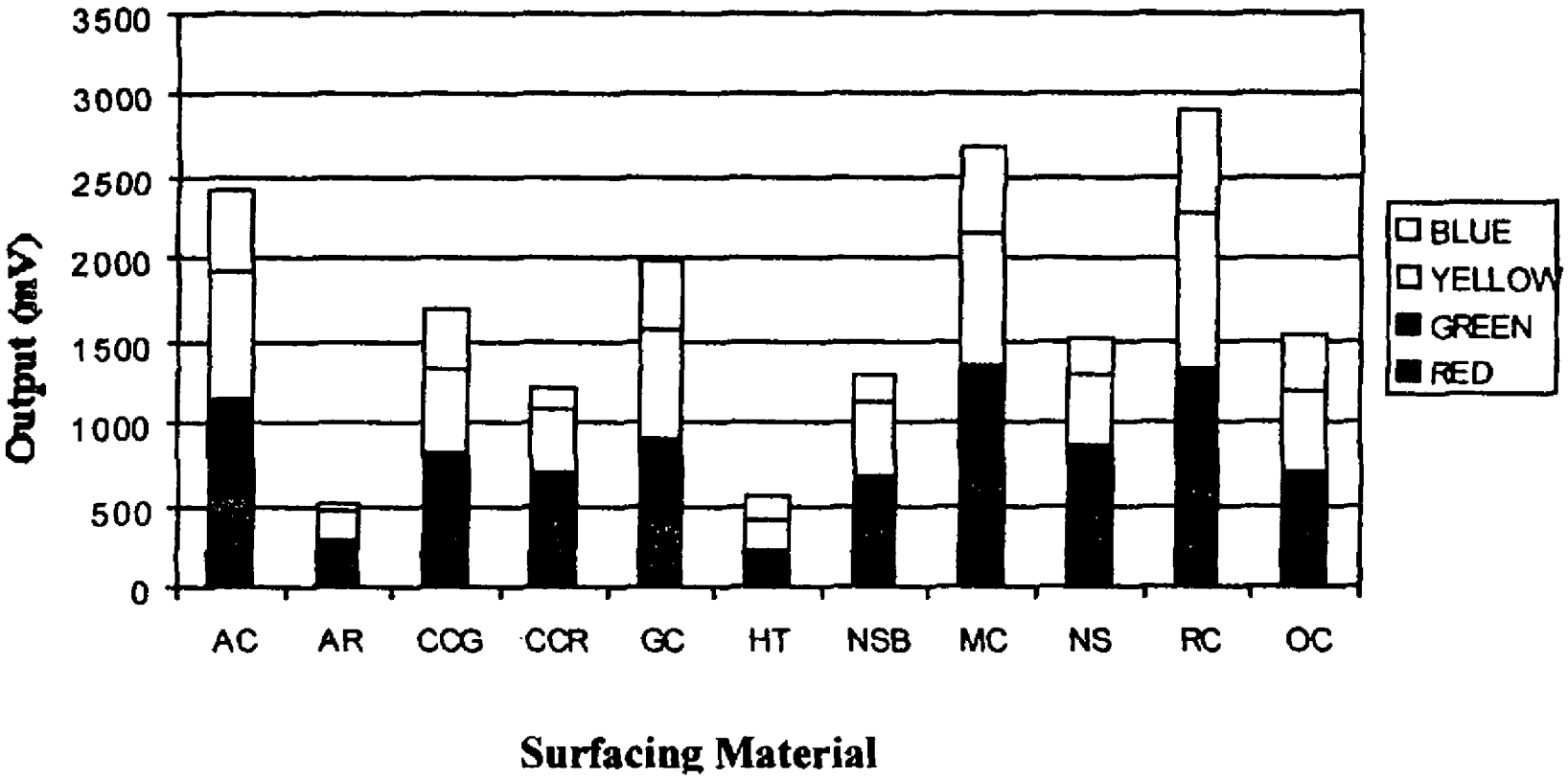
FIG. 5 shows the results of tests designed to measure the general abrasiveness of clay-like surfacing materials. The abbreviations are: amber cullet (AC), mixed cullet (MC), red cullet (RC), green cullet (GC), natural sand with crushed brick (NSB) and without brick (NS), Classic Clay red (CCR), Classic Clay green (CCG), Har-Tru Regular Blend (HT), and Har-Tru American Red (AR).

A standardized painted block was scrubbed with each material utilizing the scrubbing machine as described above, with the amount of paint removed was measured by an in-house optical instrument. A bar graph of all diode results is shown in FIG. 5. The higher values reflect more paint removed, and, consequently, a more abrasive material. The test revealed three main clusters. The most abrasive cluster included amber cullet (AC), mixed cullet (MC), red cullet (RC) and green cullet (GC). The second cluster included the natural sand with crushed brick (NSB) and without brick (NS), Classic Clay red (CCR) and Classic Clay green (CCG). The least abrasive cluster contained Har-Tru (HT) and Har-Tru American Red (AR). The differences between the results of the cullets, the Classic Clays and the natural sands are not large enough to present a problem in performance.

These results correlate with the breakdown over time data and the fine sizing times from the ball mill. Mixed cullet takes the longest by far to grind and the clear cullet the shortest. However, again the red cullet gave unexpected results. It is readily broken down in the ball mill and in the breakdown over time test, so it was expected to exhibit low abrasiveness.

Even though previous in-house testing revealed that cullet is less abrasive than silica (the main component of Classic Clay), the polymer coating lessens the abrasiveness of the material. However, this coating is removed over time. The samples tested for this experiment were virtually unused material. Thus, it is expected that as the coating is removed from the Classic Clays, they will become more and more abrasive. The Har-Tru and American Red were less abrasive than the other materials tested. This is expected based on their structure and correlates to the breakdown over time tests, in which the Har-Tru sample changed the most.

b. Tennis Shoes

Figure 6:
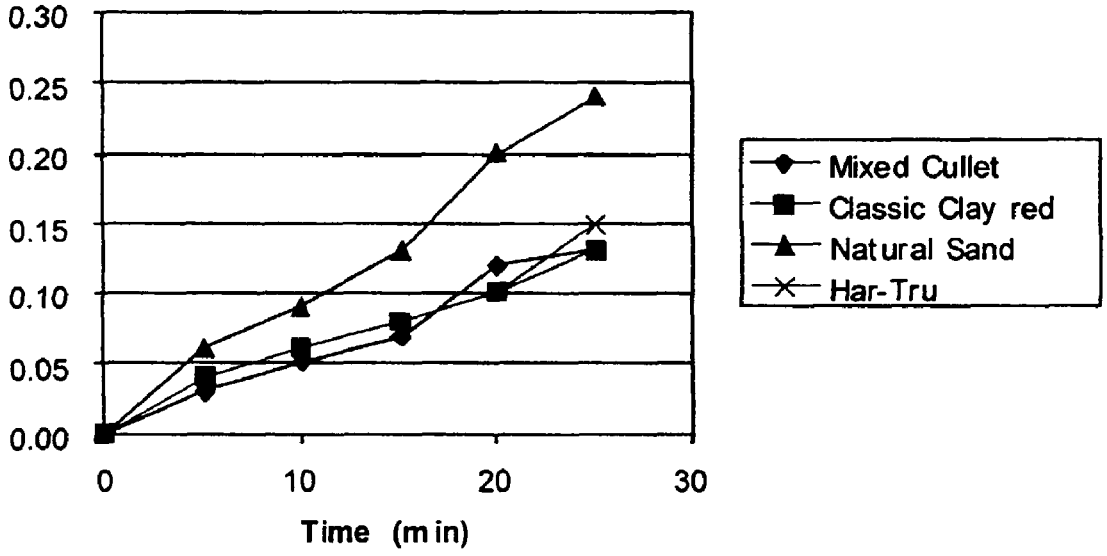
FIG. 6 shows the results of tests designed to measure the abrasiveness of clay-like surfacing materials on tennis shoes.

The abrasiveness of different surfacing materials on tennis shoes was tested. Surfacing material was adhered to paper in place of the felt pad, and the shoe rubber was scrubbed with it. Abrasiveness was evaluated by change in weight over time (FIG. 6). Natural sand was found to be the most abrasive. Classic Clay red, Har-Tru and mixed cullet all tested similarly.

c. Tennis Ball Felt

To test the abrasiveness on tennis balls, tennis ball felt was obtained from Tex-Tech. Tex-Tech supplies the felt for many of the tennis ball manufacturers, including Penn and Wilson. The amber cullet was found to be the most abrasive on the tennis ball felt closely followed by the Classic Clay red (data not shown). The American Red was the least abrasive. Again the abrasiveness of the cullet samples tested is within the range of materials currently utilized on clay-like courts.

Calculation of Coefficients of Kinetic Friction and Restitution

A. Coefficient of Kinetic Friction

Figure 7:
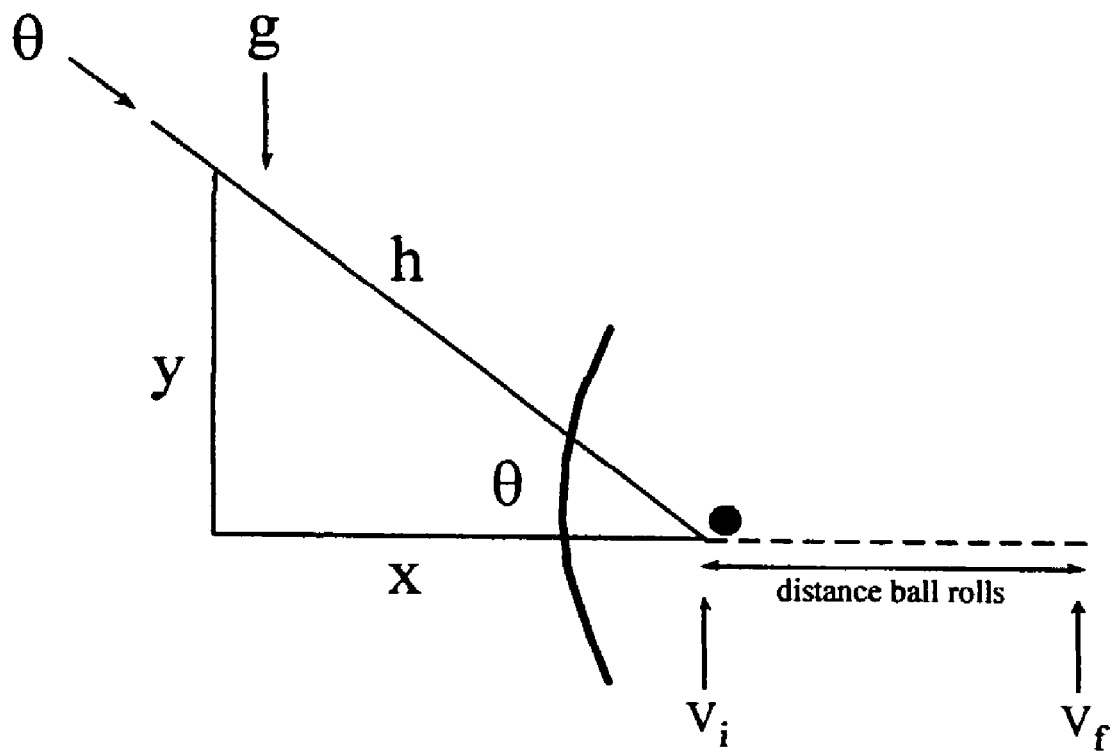
FIG. 7 gives a schematic of the instrument and test system used to test the surfacing materials for the coefficient of kinetic friction.

An instrument was built to test for the coefficient of kinetic fiction (roll rate) giving quantitative results to measure the "feel of play." The roll rate of the ball varies from surface to surface. Generally, soft courts are a slow surface, while hard courts are fast. Turning to FIG. 7, the instrument is set at a triangular position giving a constant angle, and the ball gives a constant weight. The ball rolls down the hypotenuse and enters the variable system, the court surface. Using the distance it takes the ball to come to a complete stop, the coefficient of kinetic friction can be calculated. The value can never be greater than one. Also, the higher the number, the slower the play.

The instrument allows for calculation of the coefficient of kinetic friction by utilizing geometry and Newton's second law, F=ma. The geometric relationships are shown schematically in FIG. 7.

For the instrument used by the inventor, the known variables are:

y=0.18 m
x=1.50 m
m=0.0554 kg (mass of ball)
g=9.8 M/s$^2$.

h and θ can be easily calculated from the following geometric equations:

$$h=1.51\text{ m}$$

$$\theta=6.8°$$

The horizontal force acting upon a body is:

$$F_X=mg\sin\theta$$

and from Newton's second law;

$$F=ma$$

Combining the two equations gives:

$$mg\sin\theta=ma$$

Solving for a gives:

$$a_X=g\sin\theta=1.16\ m/s^2$$

The equation for the horizontal velocity is:

$$V_x^2=V_{ox}^2+2a_x x$$

$V_{ox}$ is 0, as the ball is initially at rest. Solving for $V_x$ gives:

$$V_x=1.87\ m/s$$

To calculate the coefficient the test data must be used. Again referring to FIG. 7, the initial velocity $V_i$ equals $V_{ox}$. The final velocity, $V_f$, or $V_x$ equals zero since the ball comes to rest. Using the equation for the horizontal velocity and solving for $a_x$ gives:

$$a_x=-V_x^2/2x$$

For a given x, the distance the ball rolls, the deceleration $a_x$ can be calculated. The coefficient of kinetic friction can be calculated by applying Newton's second law to frictional forces. The magnitude of the kinetic friction is defined in equation:

$$f_k=\mu_k mg$$

Applying Newton's second law and solving for $\mu_k$ gives:

$F=f_k=ma$
$ma=\mu_k mg$
$\mu_k=a/g$

μk is less than or equal to 1 and has no units.

These results demonstrate how the surface acts against the ball and are given in Table 9. As expected, hard courts gave a much lower number than any other surface. This is reflected in the speed of play; less friction results in a faster feel of play. Cullet courts will be considered a slow surface, consistent with the other clay-like surfaces. Two values were calculated for Nova Sand courts; one court was filled as recommended by the manufacturer to simulate a grass court (Nova grass), the other was filled to resemble a clay court, where additional Nova Sand was added and spread over the top of the turf. A simple change in the amount of fill gave different values and a different feel of play.

B. Coefficient of Restitution

Calculation of the coefficient of restitution, c, is simpler than the coefficient of kinetic friction. The coefficient of restitution is defined as the relative velocity just after a collision to the relative velocity just before. For example, a very bouncy ball has a coefficient of restitution very near one, while a very "dead" object will have a value that is nearer to zero. Perhaps surprisingly, the coefficient of restitution depends mainly on the materials and not on the actual speeds.

c=velocity of separation/velocity of approach or $c=V_2/V_1$

The law of conservation of mechanical energy states that where the force of gravity is the only force doing work on the object, the total mechanical energy of the object remains constant. The test system then gives:

$$mgy(\text{potential energy})=(1/2)mV^2(\text{kinetic energy})$$

where y equals the height for the test systems. Solving for velocity and applying $c=V_2/V_1$ gives:

$$c=\sqrt{h/H}$$

where H is the known height and h the measure the height of the rebound. The coefficient of restitution is then calculated from the square root of the ratio of the rebound height to the height from which the ball was dropped. Thus, for each test, a tennis ball was dropped from a known height, and the rebound height measured. The ball used was a new Penn 4, which weighed 0.0554 kg.

The feel of play is converted into numbers that can easily be compared (see below, Table 9). The values were calculated for normal playing conditions. A smaller variance is seen in the coefficient of restitution than the coefficient of friction. The hard court values reflects the fact that hard courts are a fast playing surface; the ball has the highest rebound on hard courts. The cullet results are similar to the other clay-like surfacing materials. In general, cullet courts will produce slow play with a lower bounce.

TABLE 9

Coefficients of Kinetic Friction and Restitution for Surfacing Materials

| Surfacing Material | Coefficient of Kinetic Friction | Coefficient of Restitution |
|---|---|---|
| Hard court | 0.050 | 0.814 |
| Classic Clay red used as in-fill | 0.125 | 0.805 |
| Mixed cullet natural sand match | 0.126 | 0.791 |
| Natural sand | 0.135 | 0.754 |
| Nova Sand used as in-fill to simulate clay | 0.148 | 0.780 |
| Har-Tru | 0.170 | 0.801 |

TABLE 9-continued

Coefficients of Kinetic Friction and Restitution for Surfacing Materials

| Surfacing Material | Coefficient of Kinetic Friction | Coefficient of Restitution |
|---|---|---|
| Mixed cullet Classic Clay match used as in-fill | 0.200 | 0.771 |
| Nova Sand used as in-fill to simulate grass | 0.220 | 0.779 |

Staining Ability of Surfacing Materials

To test the staining ability of the surfacing materials the scrubbing machine and optical instrument were utilized. Felt pieces (used for the general testing) and socks were scrubbed with each surfacing material and washed before analysis with the optical instrument. The portion that could be wiped off or washed away was not included as stain on socks and other clothing. Tennis ball felt was used to measure the potential staining of tennis balls. The tennis ball felt was not washed before analysis with the optical instrument. In general, Classic Clay red appears to stain materials very easily. Players who play frequently on Classic Clay are soon recognized by their reddish shoes and socks. Although not a significant technical problem, it is an inconvenience and a frequent complaint of players.

a. General

Figure 8:
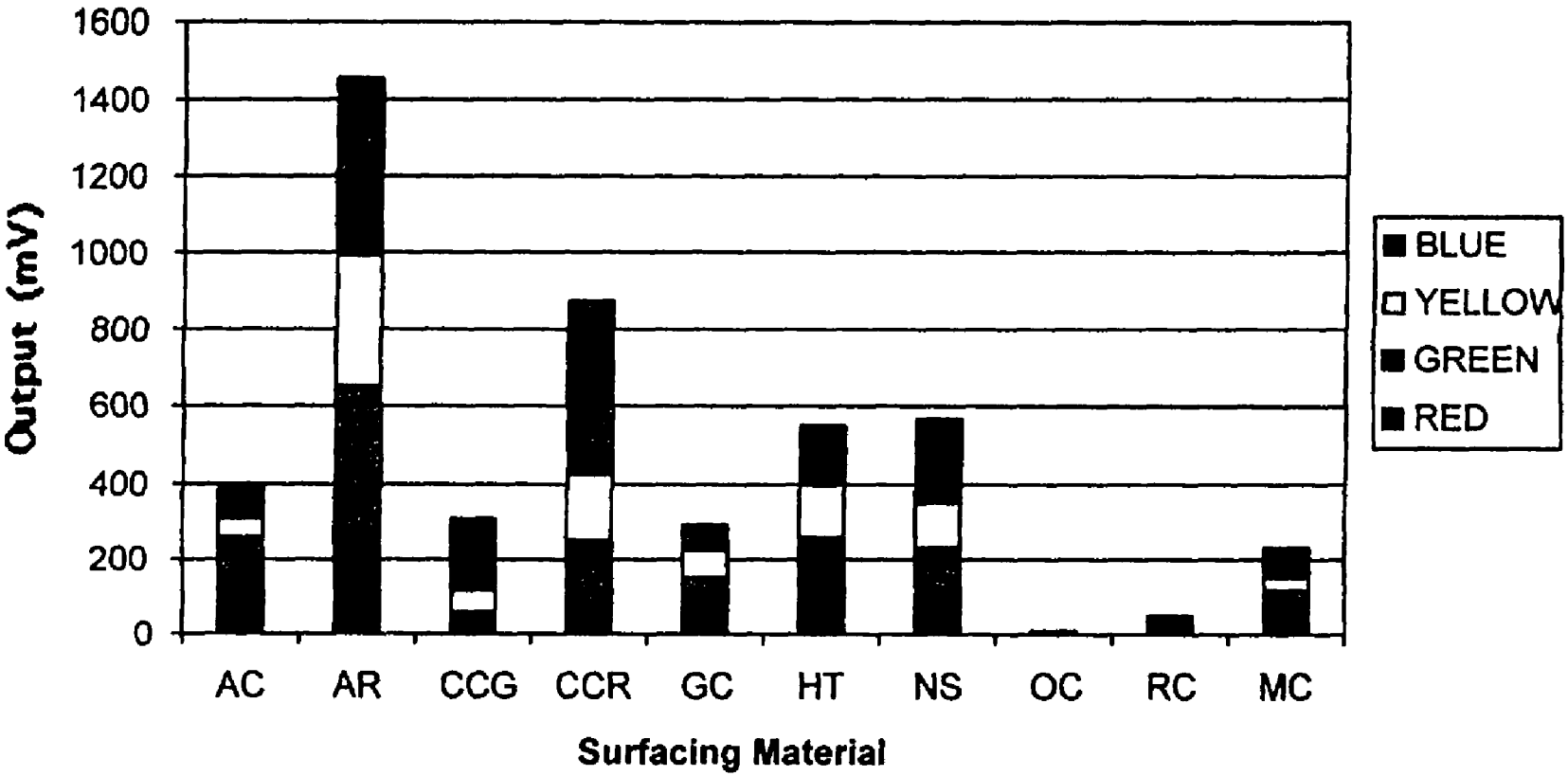
FIG. 8 shows the results of tests designed to measure the staining of felt pieces by clay-like surfacing materials.

Turning to the data in FIG. 8, the test revealed four levels of staining of felt pieces, with the higher values indicating a darker stain. The Classic Clay red and the American Red stained the most. The Har-Tru and natural sand followed, with the amber cullet, Classic Clay green, green cullet and mixed cullet next and the red cullet staining the least.

b. Socks

Figure 9:
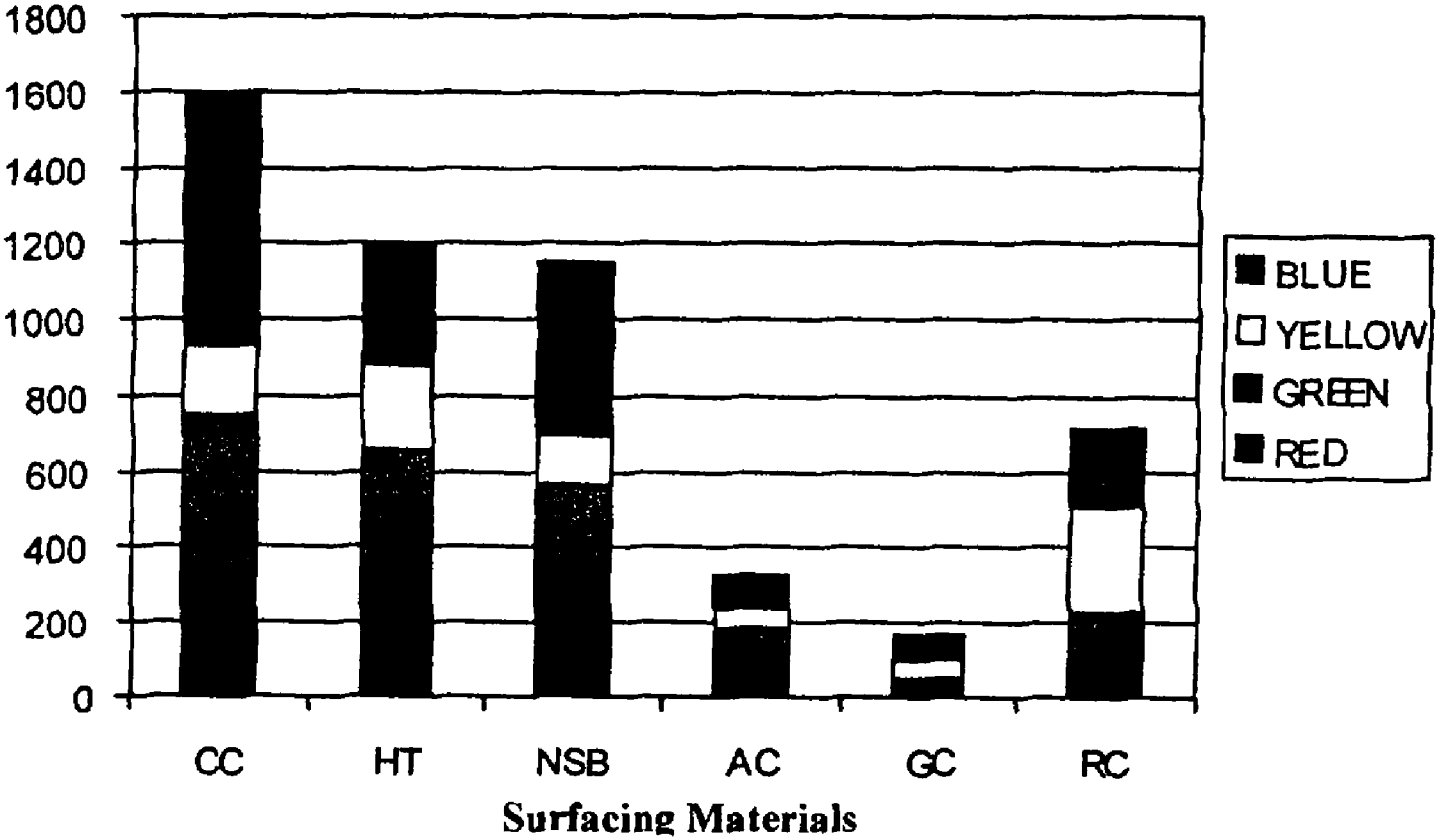
FIG. 9 shows the results of tests designed to measure the staining of socks by clay-like surfacing materials.

Similar groupings exist in the sock stain results (FIG. 9). The Classic Clay stained the most, followed more closely by the Har-Tru and natural sand. Amber cullet, green cullet, and red cullet stained the least, although the red cullet stained more than the other cullet samples. The American Red and mixed cullet were not tested.

c. Tennis Ball Felt

Figure 10:
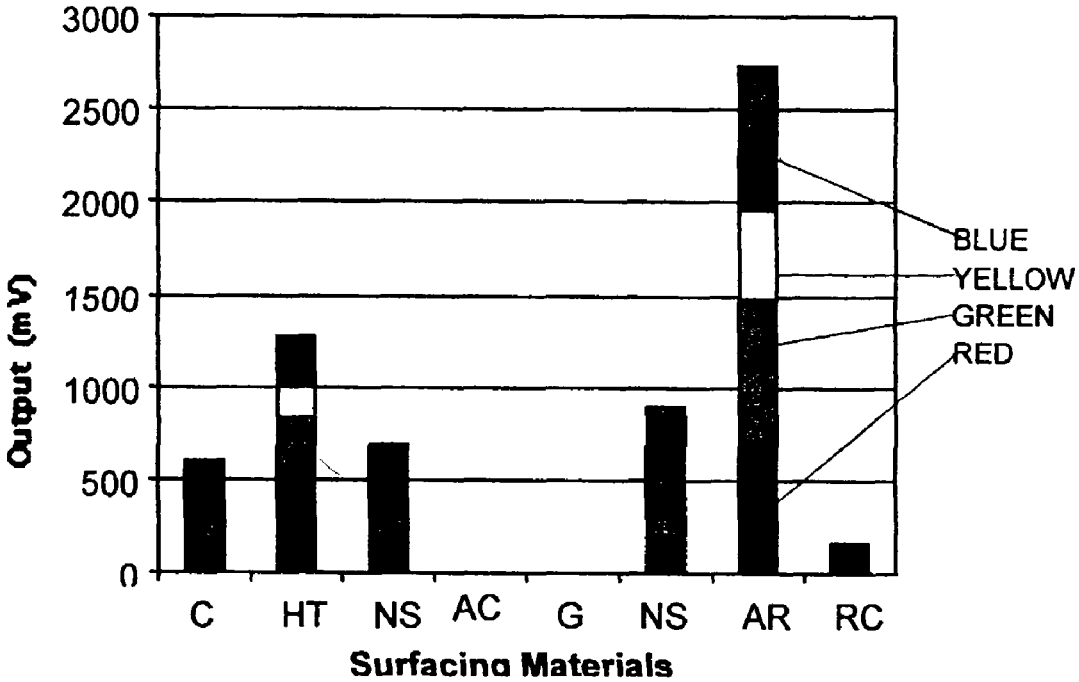
FIG. 10 shows the results of tests designed to measure the staining of tennis-felt materials by clay like surfacing materials.

Amber and green cullet were not detected as stain on the tennis ball felt (FIG. 10). The red cullet stain was detected by the instrument; although it was not detected by sight. The American Red stained significantly more than the others, followed by the Har-Tru, the natural sand with crushed brick, the Classic Clay red, natural sand, and the red cullet.

In general, the cullet samples stain the least of any of the materials, and the Classic Clay red, Har-Tru and American Red the most.

Building Pilot Test Courts

Two pilot test courts were built following the specifications given in "Tennis Courts—A Construction and Maintenance Manual," U.S. Tennis Court and Track Builders Association and United States Tennis Association, 1998. One court was built using mixed cullet as a compacted surfacing material with the cullet sized to match natural sand. The other court was built using mixed cullet as in-fill material in a similar carpet material as used for Classic Clay with the cullet sized to match Classic Clay red. The courts were used to calculate the coefficients of friction and restitution and for general evaluation of the cullet surface. The cullet handled easily during the building process, and after six months functioned similarly if not better than other clay-like surfaces. As expected, wind and rain transport have been minimal. Both courts dry quickly, are playable after a rain and are not muddy, sticky or slippery like other clay-like surfacing materials can be when wet. Surface reflectivity has not been a problem.

Summary of Results

The cullet surfaces tend to have characteristics favorable for a clay-like tennis court surface. The play is slow, and cullet is not easily broken down or transported by wind or rain. Moreover, the reflectivities are similar to natural sand and Nova Sand currently in use, cullet does not stain readily, and has shown abrasiveness towards shoes and balls that is similar to most other surfacing materials. All tests suggested by the United States Tennis Association and United States Tennis Court & Track Builders Association were completed as described above. Sufficient data have been collected to establish cullet as a viable clay-like surfacing material.

As would be understood by those skilled in the art, any number of functional equivalents may exist in lieu of the preferred embodiments described above. Thus, as will be apparent to those skilled in the art, changes in the details and materials that have been described may be within the principles and scope of the invention illustrated herein and defined in the appended claims.

Accordingly, while the present invention has been shown and described in what is believed to be the most practical and preferred embodiments, it is recognized that departures can be made therefrom within the scope of the invention, which is therefore not to be limited to the details disclosed herein but is to be accorded the fill scope of the claims so as to embrace any and all equivalent products.

I claim:

1. A clay-like tennis court, comprising:

a tennis court substrate; and granular cullet particles having a size between 0.99 millimeters to about 20 microns disposed over the tennis court substrate.

2. The tennis court of claim 1, wherein the granular cullet particles have been ground by milling and include a portion selected from the group consisting of container glass, plate glass, ceramic glass, or combinations thereof.

3. The tennis court of claim 1, wherein the granular cullet particles include a portion selected from the group consisting of amber cullet, clear cullet, red cullet, orange cullet, green cullet, blue cullet and combinations thereof.

4. The tennis court of claim 1, wherein the tennis court substrate comprises a compacted base course disposed over a compacted subgrade.

5. The tennis court of claim 1, wherein the tennis court substrate comprises a carpet and said granular cullet particles are an in-fill material.

6. The tennis court of claim 1, wherein the tennis court substrate further includes an additional ingredient mixed with the granular cullet particles, said additional ingredient being selected from the group consisting of fines, polymer coatings, or combinations thereof.

7. The tennis court of claim 1, wherein the granular cullet particles are compacted over the tennis court substrate.

8. A clay-like tennis court, comprising:

a compacted subgrade, compacted stone disposed over the compacted subgrade; and a non-pavement surfacing composition disposed over the compacted stone, said surfacing composition comprising granular cullet particles having a size between 0.99 millimeters to about 20 microns.

9. The tennis court of claim 8, wherein the granular cullet particles have been ground by milling and include a portion selected from the group consisting of container glass, plate glass, ceramic glass, or combinations thereof.

10. The tennis court of claim 8, wherein the granular cullet particles include a portion selected from the group consisting of amber cullet, clear cullet, red cullet, orange cullet, green cullet, blue cullet, and combinations thereof.

11. The tennis court of claim 8, further comprising a carpet over said compacted stone within which said granular cullet particles are disposed as an in-fill material.

12. The tennis court of claim 8, wherein the non-pavement surfacing composition further includes an additional ingredient selected from the group consisting of fines, polymer coatings, or combinations thereof.

13. The tennis court of claim 8, wherein the granular cullet particles are compacted over said compacted stone.

* * * * *

UNITED STATES PATENT AND TRADEMARK OFFICE

CERTIFICATE OF CORRECTION

PATENT NO. : 7,713,133 B2
APPLICATION NO. : 10/236354
DATED : May 11, 2010
INVENTOR(S) : Ann Marie Alia Wolf It is certified that error appears in the above-identified patent and that said Letters Patent is hereby corrected as shown below:

Title Page, Item (63) should be inserted to read

-- (63) Related U.S. Application Data

Continuation-in-part of Application No. 09/871,091, filed on May 31, 2001, now Pat. No. 6,448,216. --

Signed and Sealed this

Twenty-second Day of June, 2010

David J. Kappos

David J. Kappos
*Director of the United States Patent and Trademark Office*